US010378149B2

(12) United States Patent
Lindblom

(10) Patent No.: US 10,378,149 B2
(45) Date of Patent: Aug. 13, 2019

(54) REFINER PLATE SEGMENT WITH PRE-DAM

(71) Applicant: Valmet AB, Sundsvall (SE)

(72) Inventor: Thommy Lindblom, Hägersten (SE)

(73) Assignee: Valmet AB (SE)

( * ) Notice: Subject to any disclaimer, the term of this patent is extended or adjusted under 35 U.S.C. 154(b) by 210 days.

(21) Appl. No.: 15/588,900

(22) Filed: May 8, 2017

(65) Prior Publication Data

US 2017/0362773 A1 Dec. 21, 2017

(30) Foreign Application Priority Data

Jun. 15, 2016 (SE) ..... 1650847

(51) Int. Cl.

| | |
|---|---|
| ***B02C 7/00*** | (2006.01) |
| ***B02C 7/02*** | (2006.01) |
| ***B02C 7/12*** | (2006.01) |
| ***D21D 1/30*** | (2006.01) |
| ***B02C 7/04*** | (2006.01) |
| ***D21C 3/22*** | (2006.01) |

(52) U.S. Cl.

CPC ..... *D21D 1/306* (2013.01); *B02C 7/00* (2013.01); *B02C 7/02* (2013.01); *B02C 7/04* (2013.01); *B02C 7/12* (2013.01); *D21C 3/222* (2013.01); *D21D 1/30* (2013.01); *D21D 1/303* (2013.01)

(58) Field of Classification Search

CPC .... B02C 7/02; B02C 7/04; B02C 7/12; D21D 1/30; D21D 1/303; D21D 1/306; B24B 37/26

See application file for complete search history.

(56) References Cited

U.S. PATENT DOCUMENTS

2005/0107009 A1* 5/2005 Muldowney ..... B24B 37/26 451/41
2006/0151648 A1* 7/2006 Vuorio ..... B02C 7/12 241/261.2
2008/0296419 A1 12/2008 Gingras
2010/0314476 A1 12/2010 Vuorio
(Continued)

FOREIGN PATENT DOCUMENTS

CN 101324035 A 12/2008
CN 201581293 U 9/2010
(Continued)

OTHER PUBLICATIONS

Chinese Search Report for CN201710451727.5 dated Apr. 23, 2019.

*Primary Examiner* — Shelley M Self
*Assistant Examiner* — Bobby Yeonjin Kim
(74) *Attorney, Agent, or Firm* — Lerner, David, Littenberg, Krumholz & Mentlik, LLP

(57) ABSTRACT

The invention relates to a refiner plate segment in a refiner plate for mechanically refining of lignocellulosic material in a refiner, said refiner plate segment comprising at least a first, generally radially extending bar, a second, generally radially extending bar, a groove arranged and defined between said first, generally radially extending bar and said second, generally radially extending bar, and a main dam, which has a height H and is arranged in the groove, wherein a pre-dam is arranged in front of the main dam, said pre-dam has a height h which is less than the height H of the main dam.

8 Claims, 3 Drawing Sheets

(56) References Cited

U.S. PATENT DOCUMENTS

| | | | | |
|---|---|---|---|---|
| 2013/0320119 | A1* | 12/2013 | Gingras | B02C 7/12 241/28 |
| 2014/0110511 | A1 | 4/2014 | Antensteiner | |
| 2015/0158141 | A1* | 6/2015 | Aoki | B24B 37/245 451/41 |

FOREIGN PATENT DOCUMENTS

| | | | |
|---|---|---|---|
| CN | 101883893 | A | 11/2010 |
| CN | 201738181 | U | 2/2011 |
| CN | 201835175 | U | 5/2011 |
| CN | 203668751 | U | 6/2014 |
| WO | 2009040477 | A1 | 4/2009 |

* cited by examiner

REFINER PLATE SEGMENT WITH PRE-DAM

TECHNICAL FIELD

The present invention relates generally to a refiner, such as a disc-type refiner, and particularly to a refiner plate to be used in such a refiner, and even more particularly to a dammed refiner plate segment, which is part of a refiner plate and which comprises a pre-dam arranged in front of a main dam.

BACKGROUND OF THE INVENTION

Lignocellulosic material, e.g., wood chips, saw dust and other fibrous material from wood or plant, is refined by mechanical refiners that separate fibers from the fiber network that forms the lignocellulosic material. A typical refiner for processing fibrous material is a disc-type refiner, wherein two refiner plates—which also are referred to as refiner discs—are positioned opposite to each and wherein at least one refiner plate rotates with respect to the other refiner plate. A rotating refiner plate or refiner disc may be referred to as a rotor, while a stationary refiner plate or refiner disc may be referred to as a stator. The rotor and stator plates comprise refiner plate segments, which can be mounted directly on the rotor and stator, respectively, or can be mounted by means of special segment holders. The lignocellulosic material to be refined is fed into a central inlet in at least one of the two refiner plates, and moves therefrom into a refining gap arranged between the two refiner plates. As at least one of the refiner plates rotates, centrifugal forces created by the relative rotation between the two refiner plates move the lignocellulosic material outwards and towards the periphery of the refiner plates. The opposing refiner plates comprise refiner plates segments, which have surfaces that include bars and grooves; and the lignocellulosic material is—in the refining gap provided between crossing bars of the opposing refiner plate segments—separated into fibers by forces created by the crossing bars as the refiner plates rotate in relation to each other. Besides moving in the refining gap between the bars of the opposing and rotating refiner plates, lignocellulosic material may also move outwardly within the grooves provided in a refiner plate segment. When moving within a groove, the lignocellulosic material is not subjected to the aforementioned forces created between crossing bars of opposing and rotating refiner plates, and there is consequently no fiber separation. To remedy this unwanted situation, it is known to provide the grooves with dams, i.e. transverse restrictions, which force the flow of lignocellulosic material out of a groove and into the refining gap between crossing bars between opposing and rotating refiner plates. The U.S. Patent Application No. 20140110511 to Antensteiner discloses refiner plate segments of this type, which include fully dammed grooves or partially dammed grooves. At least some of the dams disclosed in this patent application are full-height dams, which implies that the bottom of the dam is the substantially flat bottom surface of the groove in which the dam is positioned and the top of the dam is at substantially the same height as the bars surrounding and defining this groove.

Although a refiner plate design with dammed grooves works well for its main purpose, i.e. to force the flow of lignocellulosic material out of a groove and into the refining gap between crossing bars of opposing and rotating refiner plates, it is associated with drawbacks. A dam of this type, in particular a full-height dam, is subjected to a considerable wear since the flow of lignocellulosic material in a groove encounters and collides with the dam at high speed and at an almost perpendicular angle. Thus, the dam arrangement constitutes a substantial flow restriction, which creates forces that act against the rotational direction of the refiner plate. Refiners comprising refiner plates with dammed grooves are therefore typically accompanied by a high energy consumption. Since dams force the flow of lignocellulosic material out of a groove and into the refining gap in a rather abrupt and uncontrolled way, the flow distribution is typically also less than optimal in a refiner plate segment with dammed grooves, which, in turn, may lead to a deteriorated, or at least compromised, fiber quality.

An object of the present invention is therefore to provide an improved refiner plate or refiner plate segment, which reduces the wear of the dams and thereby provides a longer useful segment life-time. A further object is to provide an improved refiner plate or refiner plate segment, which reduces the energy consumption in a refiner equipped with such refiner plates. A still further object is to provide an improved refiner plate or refiner plate segment, which provides a better flow distribution and thereby an improved fiber quality.

SUMMARY OF THE INVENTION

The above-mentioned objects are achieved with a refiner plate and a refiner plate segment according to the independent claims. Preferred embodiments are set forth in the dependent claims.

According to one embodiment of the present invention, a refiner plate comprises at least one refiner plate segment, which, in turn, comprises at least one groove. The groove extends in a generally radial direction as seen from the center of the refiner plate, and is on its two radial sides surrounded by bars, which consequently also extend in the generally radial direction. Thus, the height of the bars defines the depth of the groove. The length of the groove as seen in the generally radial direction is restricted by two dams, i.e. a first dam is arranged at an inner, smaller radius and a second dam is arranged at an outer, larger radius, as seen from the center of the refiner plate. Such a dam has a height which is substantially equal to the height of the bars which surround and define the groove, and is herein referred to as a main dam. Now, according to the invention, a refiner plate segment, which comprises a groove, whose width is restricted and defined by two radially extending bars and whose radial length is restricted and defined by two main dams, i.e. a first, inner dam and a second, outer dam, comprises a further dam, which herein is referred to as a pre-dam as it is located in front of, as seen in the radial direction, the outer main dam. The pre-dam has height which is less than the height of the main dam, and is located at a relatively short distance from the main dam. In one embodiment of the invention, the pre-dam and the main dam both have straight profiles, and in another embodiment the pre-dam and the main dam both have chamfered profiles. Other embodiments of the invention include combinations of straight and chamfered profiles, e.g. a straight pre-dam and a chamfered main dam, or a chamfered pre-dam and a straight main dam.

By arranging a pre-dam, which has a height that is less than the height of a main dam, in front of a main dam, the flow of lignocellulosic material first encounters the pre-dam, and, since the height of the pre-dam is relatively less than the height of the main dam, the change of flow direction is relatively less pronounced when the material flow encounters a pre-dam than when the material flow encounters a main dam, as will be thoroughly explained and described below. The change of flow direction for the lignocellulosic material can be regarded as a "lift" from a radial movement within a groove to an additional movement into a refining gap provided between two opposing refiner plates, or, more specifically, between crossing bars provided on two opposing and rotating refiner plates. Because of this lift, which has already been achieved by a pre-dam, the material flow will encounter a main dam at angle which is less than a perpendicular angle, which causes less wear on the main dam and thereby contributes to a longer useful lifetime for the refiner plate segment. The relatively smoother change of flow direction reduces the impact of the main dam on the material flow and leads to a decreased energy consumption. The change of flow direction is also less abrupt and more controlled when a pre-dam is arranged in front of a main dam, which leads to an improved flow distribution, which, in turn, improves fiber quality.

BRIEF DESCRIPTION OF THE DRAWINGS

The present invention will be further explained hereinafter by means of non-limiting examples and with reference to the appended drawings, wherein.

DETAILED DESCRIPTION OF PREFERRED EMBODIMENTS

Figure 2:
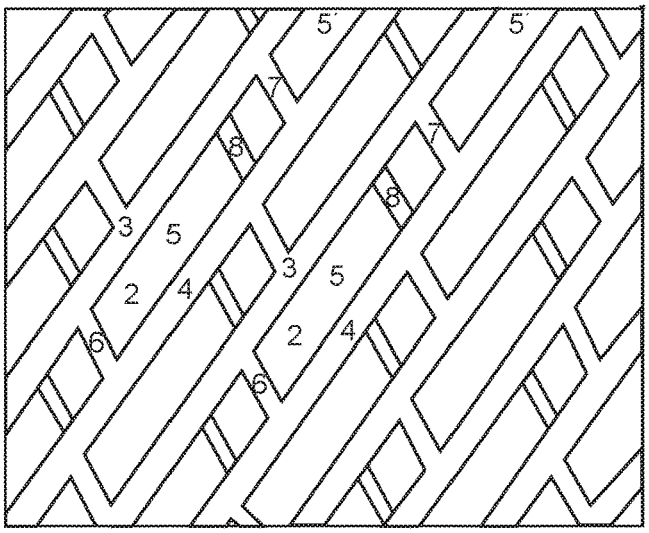
FIG. 2 shows a portion of the refiner plate segments of FIG. 1 in an enlarged view.
Figure 3:
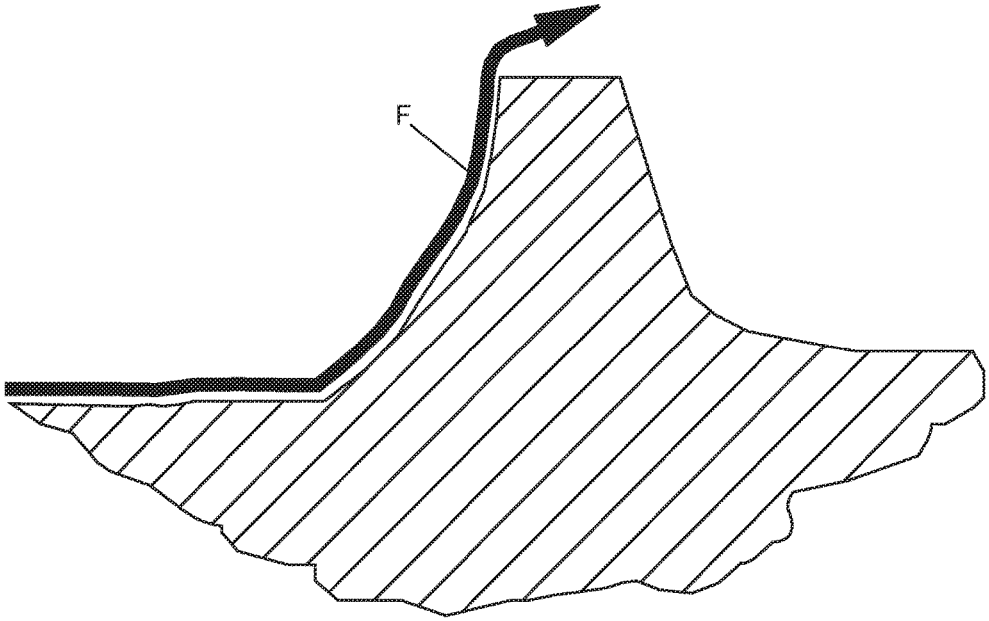
Fig.3 (Prior Art)
FIG. 3 illustrates schematically the flow of material over a dam according to the prior art.

Below, the general shape and design of a refiner plate and a refiner plate segment according to the invention will first be explained with reference to FIG. 1 and FIG. 2; thereafter the advantages achieved over the prior art with such a refiner plate and refiner plate segment will be demonstrated with reference to FIG. 3 and FIG. 4, respectively; while specific ranges of dimensions for a first embodiment and a second embodiment of the invention will be presented with reference to FIG. 5 and FIG. 6, respectively.

Figure 1:
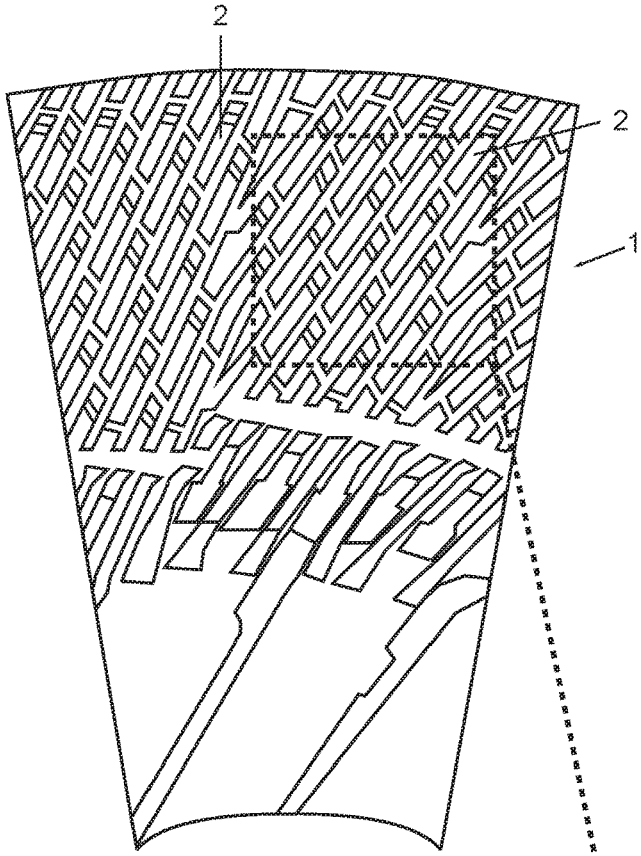
FIG. 1 is schematic illustration of a section of a refiner plate comprising refiner plate segments according to the present invention.

FIG. 1 illustrates schematically a section of a refiner plate 1 according to the present invention. The refiner plate 1 comprises a number of segments 2, of which at least one segment 2 is provided with at least two bars, i.e. a first bar 3 and a second bar 4, as is best seen in the enlarged view of FIG. 2. The first bar 3 and the second bar 4 extend in a generally radial direction from the center of the refiner plate 1. As used herein, the term "generally radial direction" as well as similar terms and expressions includes refiner plate sections with bars that can be arranged at an angle to a perfect radial direction, including an angle which varies with the distance from the center of the refiner plate, e.g. bars that extend outwards from the center of the refiner plate 1 in a helical pattern. The first bar 3 and the second bar 4 extend upwards from a bottom surface of the refiner plate 1, such that the first bar 3 has a first height and the second bar 4 has a second height. The first height of the first bar 3 and the second height of the second bar 4 are typically equal, but it is within the scope of the present invention that the first height of the first bar 3 differs from the second height of the second bar 4. Herein, to simplify the description, all bar heights are assumed to be equal if nothing else is explicitly stated. The first bar 3 and the second bar 4 define a groove 5 between themselves. The groove 5 extends consequently also in a generally radial direction and has a main depth given by the first height of the first bar 3 and the second height of the second bar 4. (If the first height of the first bar 3 differs from the second height of the second bar 4, the main depth of the groove 5 is taken to be equal to the shortest one of the first height and the second height.) The width of the groove 5 is determined by the circumferential distance between the first bar 3 and the second bar 4. The radial extension of the groove 5 is limited and thereby defined by a first or inner main dam 6 and a second or outer main dam 7, to thereby give the groove 5 a radial length, i.e. the radial length of the groove 5 is measured in the same generally radial direction as the extension of the groove 5. The first or inner main dam 6 has a height, which typically is equal to the height of the first bar 3 and/or equal to the height of the second bar 4, but it is within the scope of the present invention that the height of the first dam 6 differs from both the height of the first bar 3 and from the height of the second bar 4. The second or outer main dam 7 has a height, which typically is equal to the height of the first main dam 6, but it is within the scope of the present invention that the height of the second main dam 7 differs from the height of the first main dam 6, i.e. the height of the second main dam 7 can differ from the height of the first bar 3 and/or from the height of the second bar 4 and/or from the height of the first main dam 6.

Now, according to the invention, the groove 5 is provided with a further dam 8, which herein is referred to as a pre-dam 8, since it is positioned at a relatively short distance in front of the second or outer main dam 7, as seen from the center of the refiner plate 1. As should be understood from the present description and the figures, a second or outer main dam, such as main dam 7, which is arranged in a groove, such as groove 5, constitutes a first or inner main dam for a radially adjoining groove. For example, in FIG. 2, main dam 7, which is a second or outer main dam for groove 5, constitutes a first or inner main dam for a radially adjoining groove 5'. Since, as used herein, the prefix "pre" in the term "pre-dam" always relates to a main dam, which is disposed further out from the center of a refiner plate, the terms "first", "second", "inner" and "outer" are hereby dropped in conjunction with the description of a combination of a pre-dam and a main dam for ease of understanding of the invention. While all other heights which have been referred to above typically are equal, the pre-dam 8 has a height which is less than the height of the main dam 7, as will be more clearly seen and thoroughly discussed below in conjunction with FIG. 5 and FIG. 6, respectively.

To better appreciate the functionality and thereby the advantages of providing a pre-dam in front of a main dam in accordance with the present invention, the functionality of a conventional dam will first be described with reference to FIG. 3, which schematically illustrates the material flow over a dam according to the prior art. In FIG. 3, the material flow is illustrated by the thick arrow F, and it can be seen that the material flow F encounters a dam at a rather large angle, although the dam as a chamfered profile. Since a refiner plate rotates at high speed and the material flow contains a large amount of abrasive particles, it can be appreciated that the dam is exposed to considerable wear. Further, the combination of a dam, which is arranged on a rotating refiner plate, and a material flow, which is moving outwards, creates forces which act against the rotation of a refiner plate, and it therefore requires energy to maintain the rotational speed of the refiner plate, which, in turn, leads to a high energy consumption. Because of the high rotational speed of a refiner plate and the large angle at which the material flow encounters a dam, the material flow distribution after a dam is not well controlled, which can lead to a fiber quality that is less than optimal.

Figure 4:
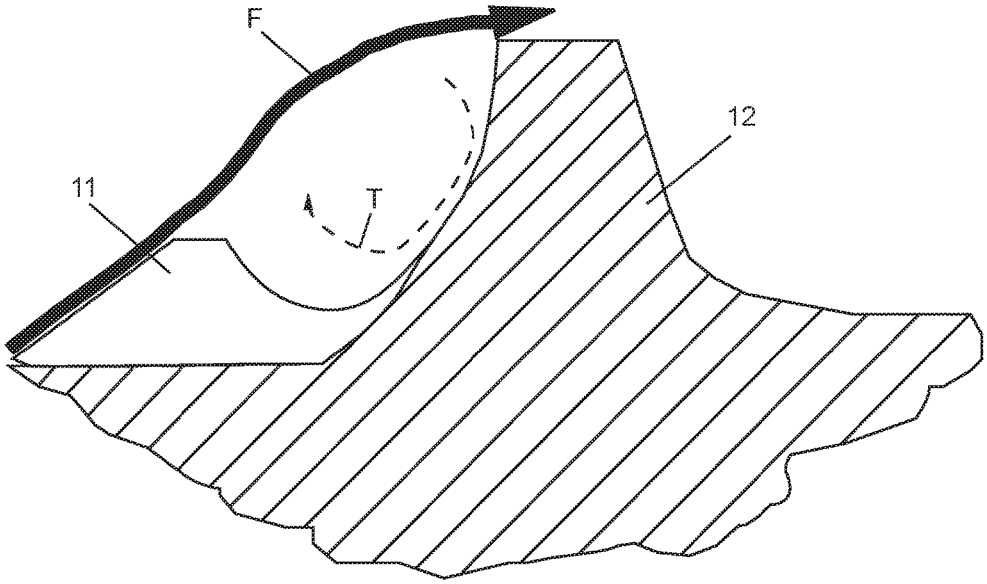
FIG. 4 illustrates schematically the flow of material over a combination of a pre-dam and a main dam according to the present invention.

FIG. 4 illustrates schematically the material flow over a combination of a pre-dam 11 and a main dam 12 according to the present invention. As should be appreciated, the material flow, which is indicated by the thick arrow F, first encounters the pre-dam 11 at a rather small angle, and as the material flow F is forced up from the bottom of the groove in which the pre-dam 11 is located and over the pre-dam 11, it is believed that turbulence is created behind the pre-dam 11. This turbulence, which is indicated by dashed arrow T, acts so as to lift the material flow F over the area between pre-dam 11 and main dam 12, and also acts to lift the material flow F over the main dam 12. The main dam 12 is thereby exposed to less wear, which increases the useful lifetime of the refiner plate segment on which the pre-dam 11 and the main dam 12 are arranged. The relatively smoother passage of the main dam 12 in comparison with the situation described and seen in conjunction with FIG. 3 above, also contributes to a less abrupt change of flow direction for the material flow F, which, in turn, contributes to a better control of the flow distribution, which should have a positive effect on fiber quality. A smooth change of flow direction has also a positive effect on the energy consumption of a refiner equipped with refiner plate segments with pre-dams arranged in front of main dams.

Figure 5:
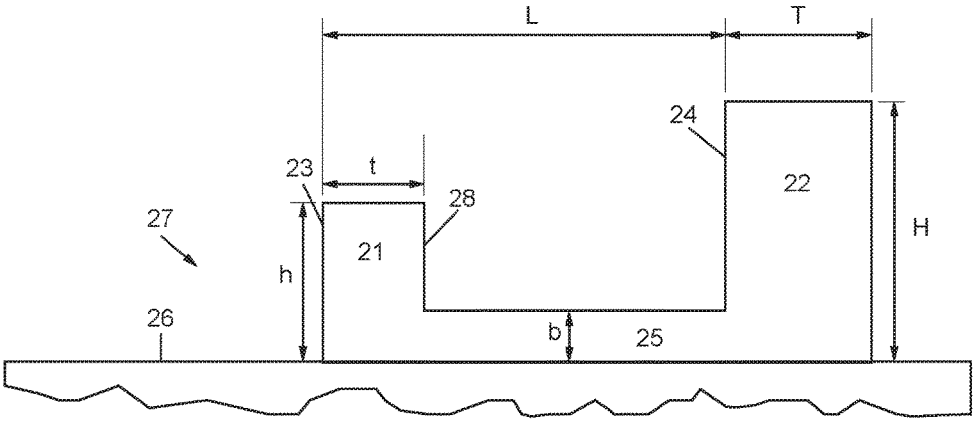
FIG. 5 is a schematic cross-sectional view of a pre-dam and a main dam according to a first embodiment of the present invention.
Figure 6:
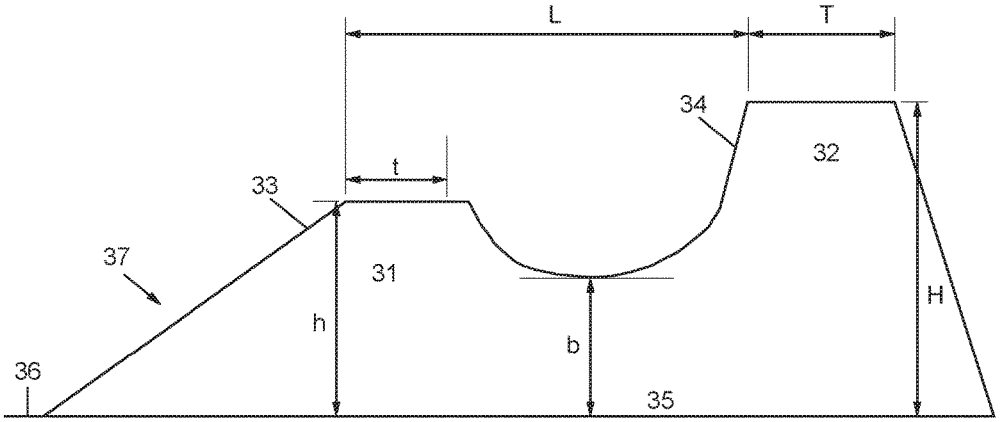
FIG. 6 is a schematic cross-sectional view of a pre-dam and a main dam according to a second embodiment of the present invention.

FIG. 5 shows a cross-sectional view of a first embodiment of a combination of a straight pre-dam 21 and a straight main dam 22. The pre-dam 21 has a height h and a width t, while the main dam 22 has a height H and a width T. The distance between the pre-dam 21 and main dam 22 is denoted by L and is measured from a leading edge 23 of the pre-dam 21 to a leading edge 24 of the main dam 22. Further, as can be seen in FIG. 5, the bottom area between the pre-dam 21 and the main dam 22 is arranged as a base plate 25 having a thickness b, i.e. the base plate 25 is elevated in relation to a bottom surface 26, which constitutes the general bottom surface 26 of a groove 27, in which the pre-dam 21 and the main dam 22 are arranged. The height h of the pre-dam 21 is less than the height H of the main dam 22, and according to the invention the height h of the pre-dam 21 can be between 0.25 per cent to 0.75 per cent of the height H of the main dam 22, i.e. $H/4 \leq h \leq 3H/4$. The thickness t of the pre-dam 21 is within the interval from almost zero to the same thickness as the thickness T of the main dam 22, i.e. $0 < t \leq T$. The distance L between the leading edge 23 of the pre-dam 21 and the leading edge 24 of the main dam 22 is such that $(H-h) \leq L \leq 3(H-h)$, and the thickness b of the base plate 23 is within the interval ranging from zero to the height h of the pre-dam 21, i.e. $0 \leq b \leq h$, and more preferably $h/4 \leq b \leq 3h/4$. Here it should in particular be appreciated that the distance L is a relatively short distance, since the height H of the main dam 22 is relatively small. Thus, the pre-dam 21 is located near the main dam 22, and it is the combination of the pre-dam 21 and the main dam 22 that provides the particular advantages of the present invention. In other words, the pre-dam 21 is not merely a dam before another dam—as is known in the prior art—instead the pre-dam 21 is a dam which is arranged a short distance in front of the main dam 22, such that the material flow, and in particular the direction thereof, still is influenced and guided by already having encountered and been directed by the pre-dam 21 when the material flow encounters the main dam 22, as was discussed and described in conjunction with FIG. 4 above. The fact that the pre-dam 21 and the main dam 22 should be regarded as a pair or a functional unit and not as individual objects is further realized in the provision of the base plate 25, which preferably has a non-negligible thickness, e.g. $h/4 \leq b \leq 3h/4$, such that the base plate 25, on which the pre-dam 21 and the main dam 22 are arranged, is located at an elevated level in relation to the bottom surface 26 of the groove 27. Alternatively, the base plate 25 can be regarded as extending from a trailing edge 28 of the pre-dam 21 to the leading edge 24 of the main dam 22 and protruding upwards with a distance b from the bottom surface 26 of the groove 27.

In the embodiment shown in FIG. 5, both a pre-dam 21 and a main dam 22 have straight profiles. It is, however, also possible that a pre-dam and a main dam have chamfered profiles, and in FIG. 6 a second embodiment of the present invention is disclosed, wherein a chamfered pre-dam 31 is arranged in front of a chamfered main dam 32, which are arranged on a base plate 35. The pre-dam 31 has a height h and a width t, while the main dam 32 has a height H and a width T. The distance between the pre-dam 31 and main dam 32 is denoted by L and is measured from a leading edge 33 of the pre-dam 31 to a leading edge 34 of the main dam 32. Further, the bottom area between the pre-dam 31 and the main dam 32 is arranged as a base plate 35 having a thickness b, i.e. the base plate 35 is elevated in relation to a bottom surface 36, which constitutes the general bottom surface 36 of a groove 37, in which the pre-dam 31 and the main dam 32 are arranged. The purpose of FIG. 6 is merely to demonstrate how the corresponding thicknesses, widths and distances are defined and can be measured in case of chamfered dam profiles. The same relations, sizes and limitations which were given above for the heights (h, H), widths (t, T) and distance (L) in the first embodiment illustrated in FIG. 5 are also valid for the second embodiment illustrated in FIG. 6. It is also within the scope of the present invention to arrange a chamfered pre-dam in front of a straight main dam, or a straight pre-dam in front of a chamfered main dam, with the corresponding measures as given in FIG. 5 and FIG. 6, respectively.

Although the present invention has been described with reference to specific embodiments, also shown in the appended drawings, it will be apparent to those skilled in the art that many variations and modifications can be done within the scope of the invention as described in the specification and defined with reference to the claims below.

The invention claimed is:

1. A refiner plate segment in a refiner plate for mechanically refining of lignocellulosic material in a refiner, said refiner plate segment comprising at least:

a first, generally radially extending bar, a second, generally radially extending bar a groove arranged and defined between said first, generally radially extending bar and said second, generally radially extending bar, a main dam, which has a height H and is arranged in the groove, and a pre-dam arranged in front of the main dam, said pre-dam having a height h which is less than the height H of the main dam, the pre-dam being arranged a distance L in front of the main dam, where L is measured from a leading edge of the pre-dam to a leading edge of the main dam and where $(H-h) \leq L \leq 3(H-h)$.

2. The refiner plate segment according to claim 1, where $H/4 \leq h \leq 3H/4$.

3. The refiner plate segment according to claim 1, including a base plate, the pre-dam and the main dam being arranged on the base plate, which has a thickness b, where $0<b<h$.

4. The refiner plate segment according to claim 1, wherein the pre-dam has a straight or chamfered profile and that the main dam has a straight or chamfered profile.

5. A refiner plate for mechanically refining of lignocellulosic material in a refiner, said refiner plate comprising at least:

a first, generally radially extending bar, a second, generally radially extending bar a groove arranged and defined between said first, generally radially extending bar and said second, generally radially extending bar, a main dam, which has a height H and is arranged in the groove and a pre-dam arranged in front of the main dam, said pre-dam having a height h which is less than the height H of the main dam, and the pre-dam is arranged a distance L in front of the main dam where L is measured from a leading edge of the pre-dam to a leading edge of the main dam and where $(H-h) \leq L \leq 3(H-h)$.

6. The refiner plate according to claim 5, wherein $H/4 \leq h \leq 3H/4$.

7. The refiner plate according to claim 5, including a base plate, the pre-dam and the main dam being arranged on the base plate, which has a thickness b, where $0<b<h$.

8. The refiner plate according to claim 5, where in the pre-dam has a straight or chamfered profile and the main dam has a straight or chamfered profile.

* * * * *